US005507665A

United States Patent [19]

Oda

[11] Patent Number: 5,507,665

[45] Date of Patent: Apr. 16, 1996

[54] ELECTRICAL CONNECTOR HAVING A MATING INDICATOR

[75] Inventor: Kenzo Oda, Hadano-shi, Japan

[73] Assignee: The Whitaker Corporation, Wilmington, Del.

[21] Appl. No.: 297,737

[22] Filed: Aug. 30, 1994

[30] Foreign Application Priority Data

Oct. 22, 1993 [JP] Japan ..... 5-057193 U

[51] Int. Cl.[6] ..... H01R 3/00

[52] U.S. Cl. ..... 439/489; 439/357

[58] Field of Search ..... 434/347, 352, 434/354, 488, 489, 357, 372

[56] References Cited

U.S. PATENT DOCUMENTS

| | | | |
|---|---|---|---|
| 4,871,325 | 10/1989 | Maejima et al. | 439/489 |
| 4,941,839 | 7/1990 | Nagasaka et al. | 439/489 |
| 5,163,848 | 11/1992 | Maeda et al. | 439/489 |
| 5,320,556 | 6/1994 | Otaka et al. | 439/489 |
| 5,376,017 | 12/1994 | Taniuchi et al. | 439/372 |

FOREIGN PATENT DOCUMENTS

| | | |
|---|---|---|
| 60-1774 | 1/1985 | Japan . |
| 4-3419 | 2/1992 | Japan . |

*Primary Examiner*—Gary F. Paumen
*Assistant Examiner*—Hien D. Vu
*Attorney, Agent, or Firm*—Mary K. VanAtten

[57] ABSTRACT

A female connector housing (10) is equipped with a rotating arm (20) which is flat with the housing (10) when the connection is complete, and is raised when the connection is incomplete. When a male connector housing (30) is inserted in the female connector housing (10), its protrusion (31) is pressed against the bottom surface (24) of the rotating arm (20) moving the rotating arm (20) away from the female connector housing (10). When the connection is accomplished, the rotating arm (20) returns to its original position against the female connector housing (10). Designated FIG. 2.

12 Claims, 3 Drawing Sheets

ELECTRICAL CONNECTOR HAVING A MATING INDICATOR

FIELD OF THE INVENTION

This invention relates to connectors, specifically to the connectors equipped with a detecting device confirming a complete connection of the male and female housings.

BACKGROUND OF THE INVENTION

Connectors became indispensable parts used for connections in wiring of electrical and electronic equipment used in cars and other applications. Generally such connectors are held together due to the friction between connected contacts and housings, however, the shortcoming of the connections with retention based on friction is that they can not withstand vibration and other impacts, which can lead to their separation.

Therefore, a number of designs was suggested regarding connectors able to withstand vibrations. Among them, there are connectors with latching devices locking in the state of complete connection that prevent their separation due to vibration.

However, since the contacts of the connectors start to form electrical contact before the state of complete connection is achieved, it is possible to make electrical connection without completely joining the housings.

In the manufacturing process, the judgment concerning the state of the connection of the housings is made by visual observation of the state of the latching device or by existence of electrical connections between the wires. However, electrical connection often exists even at an incomplete joining of the housings. Visual observation of the latching devices also can produce erroneous judgment, due to the observation angle or a human error. These factors impart reliability of connectors.

In recent years, requirements to the reliability of electrical connectors have sharply increased, especially in relation to a wide use of such safety devices as air bag systems and anti-lock brake systems, etc. Therefore, the problem of an easy confirmation of a complete joining of the connector became especially important. A number of designs of connectors were offered making it possible to easily confirm complete joining.

For example, in the connector described in Japanese Utility Publication No. (1992)-3419, an electrical detection device was proposed. In this connector, an active latching device (or a passive latching device) of one connector housing produces an open or a closed electrical contact; when the passive latching device (or an active latching device) of the other connector housing comes against the active latching device (or a passive latching device) of the first connector housing, it switches the condition of the electrical contact to opposite, thus making it possible to confirm connection.

In the Japanese Patent No. (1985)-1774, one connector housing has a built-in indicating rod movable in the direction of the joining of the housings. When this connector housing is joined with the matching connector housing, a part of that connector housing pushes the indicating rod which sticks out of the housing by the length required for the connection.

However, the above mentioned connectors equipped with opening and closing electrical contacts are very complicated and expensive to produce. They also require a special detecting circuit, thus making the price of the entire system prohibitively high.

The disadvantage of the connectors equipped with the indicating rod is the fact that the length of the exposed portion changes gradually, which may easily end in an erroneous human judgment regarding the state of connection. It also can be used in applications where the connector is out of the vision field of the assembly worker.

This invention was made with the purpose to offer low-cost and simple design connectors in which the above disadvantages are corrected, making it possible to make judgment on the state of connection based on direct visual observation or by touch.

SUMMARY OF THE INVENTION

The connectors according to this invention comprise a male connector housing and a female connector housing, and are characterized by the fact that a portion of one of the above mentioned connector housings extends from the other housing when said housings are completely joined together, and that it is equipped with a rotating arm pivoting around an axis contained in a housing which indicates the state of the completion of connection.

We were looking for a solution incorporating, for example, an active latching device and a passive latching device which can be latched only in a state of complete joining and can not be latched in any other state. These latching devices can be attached, one to each, to the male connector housing and to the female connector housing. It can be, for example, a rotating arm changing positions from being contained inside one housing and extending outside. This rotating arm can be retained by means of a spring or a rubber piece in the state when it is engaged with the passive latching device when the connector housings are in completely joined condition, and when they are not completely joined, the arm will be disengaged from the passive latching device, and will be extended outside.

When the housings of the connector according to this invention are disconnected, the rotating arm is contained inside the housing by the force of the spring. Next, when the connector housings are joined, a part of the housing other than the one to which the rotating arm is connected pushes the rotating arm in the extended position. When connector housings are pushed together in the completely joined state, the rotating arm disengages from the part of the other housing and it is returned to the original position by the force of the spring.

In the connectors according to this invention using the action described above, the rotating arm is extended outside when the housings are not completely joined and can be easily observed or detected by touch. It also makes a positive indication of the completely joined condition when the connector housings are completely engaged.

Another advantage of this design is the fact that in the disconnected condition, the rotating arm is contained inside the connector, thus saving space during transportation and preventing its loss. Since the rotating arm is contained inside the connector when the connector housings are completely joined, it also makes it possible to save valuable space in cars and other types of equipment these connectors are used in.

The rotating arm is of a simple design, and does not lead to substantial additional cost increases.

BRIEF DESCRIPTION OF THE DRAWINGS

An embodiment of the present invention will now be described by way of example with reference to the accompanying drawings, in which.

DETAILED DESCRIPTION OF THE INVENTION

Figure 1:
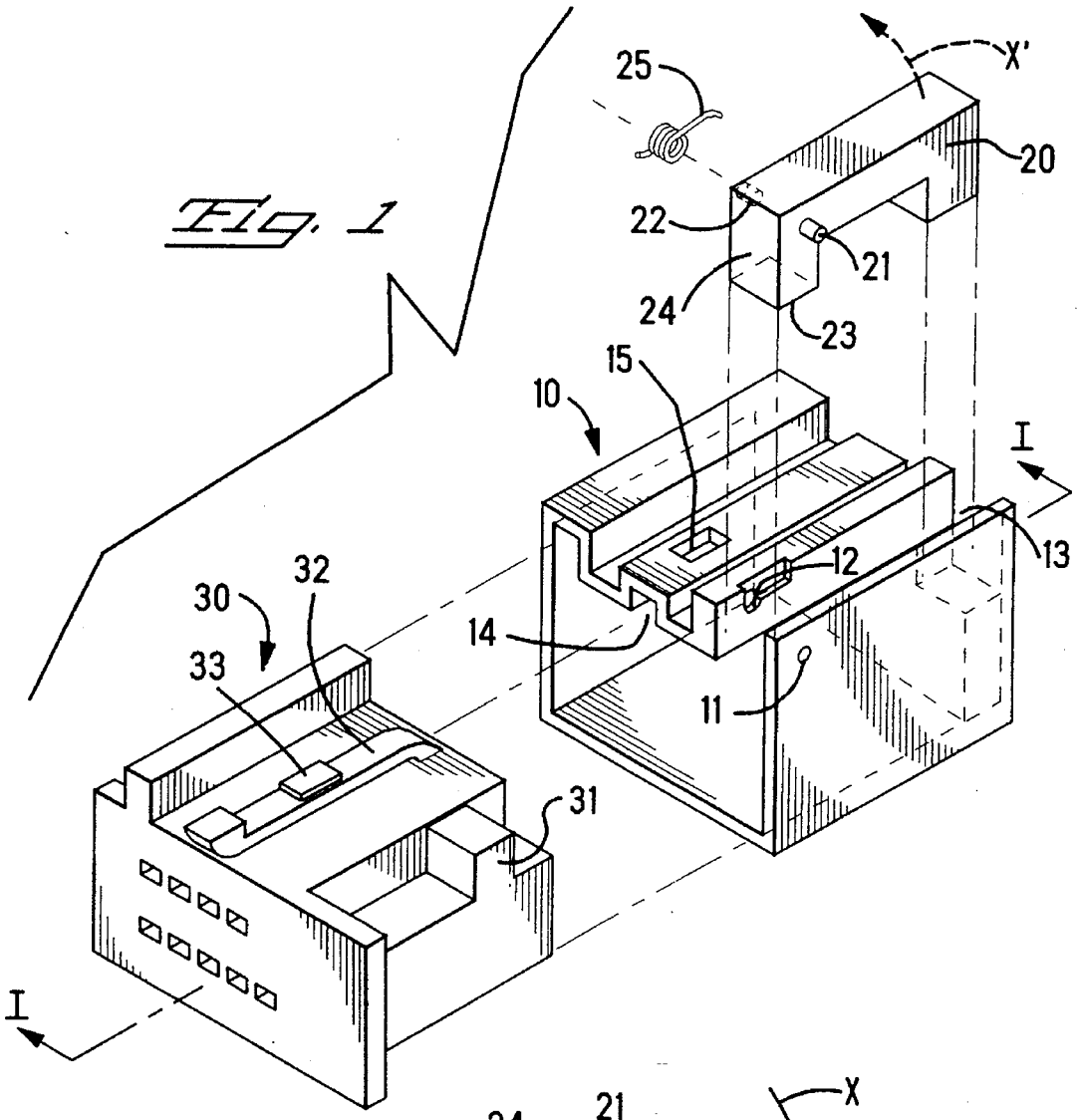
FIG. 1 is an exploded oblique view of an embodiment of the connector according to this invention.

The connector shown in FIG. 1 comprises a male connector housing 30 having a number of contacts (not shown in the drawing) to which wires are connected (shown in the drawing by dash-and-dot lines), a rotating arm 20 whose axis is secured to a female connector housing 10 which can rotate from a position flat with the female housing to a position extended outside, and a number of contacts (shown by two-dots-and-dash lines) contained in the female connector. The contacts may be located in the male connector, and the wires may be attached to the female connector.

At one end of the male connector housing 30 there is a latching element 32 joined to the housing 30 with one side. The female connector housing 10 has a groove 14 which deflects said latching element 32 down. When the two connectors are completely joined together, lug 33 of the latching element 32 fits into the slot 15 of the groove 14 of the female connector housing 10. The latching device is designed in such a manner that it prevents connectors from separating after they were joined completely.

Axes 21, 22 located at both sides of the rotating arm 20 fit into bearing surfaces 11, 12 through a passage 13 of the female housing 10, thereby fixing the rotating arm 20 to the housing 10 so that it can rotate. The rotating arm 20 is retained in the closed state by a spring 25. Since axes 21, 22 of the rotating arm 20 can widen the passage 13 to the left and the right, they fit into bearings 11, 12 of the housing 10.

Next, we will explain operation of the above connector using FIG. 2.

When the connectors are not joined (see FIG. 2 (A)), the rotating arm 20 is depressed to the closed state. This feature is designed in order to save space.

When the male connector housing (below, male housing) 30 is moved in the direction of the arrow Y, it enters the female connector housing (below, female housing) 10. When the male housing 30 is moved further, its protrusion 31 comes against the lower end 24 of the rotating arm 20. This pressure overcomes the action of the spring and starts to rotate the rotating arm 20 in the direction shown by arrow X' (see FIGS. 2(B) and (C)).

Figure 2A:
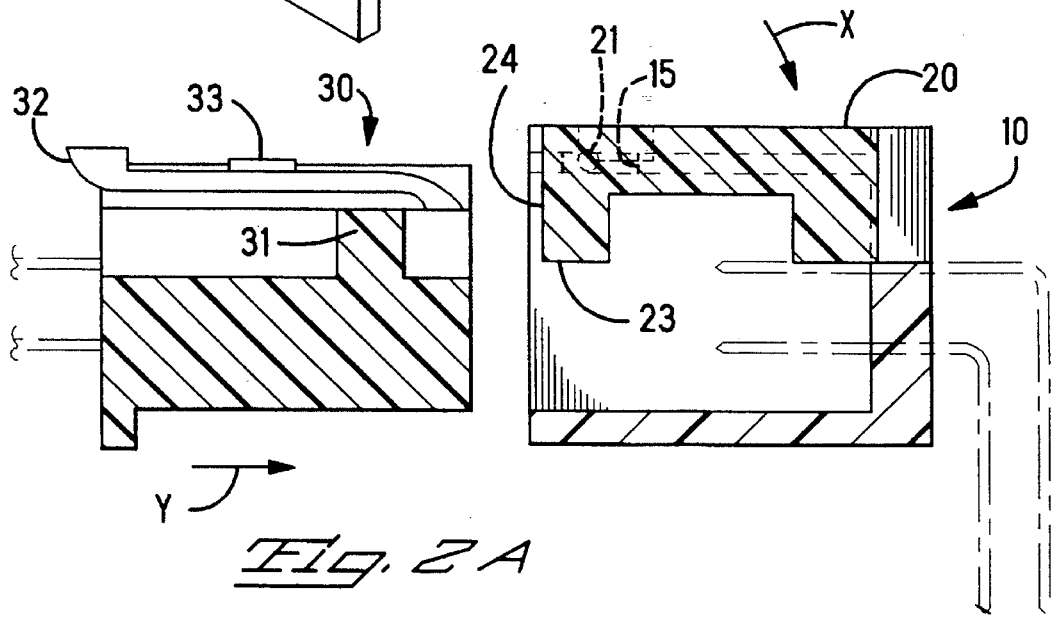
FIG. 2 is a cross sectional view of the connector shown in the FIG. 1 with the cross section made along the I—I line; (A): disengaged state; (B)–(D): various stages of incompletely joined state; (E): complete joining.
Figure 2B:
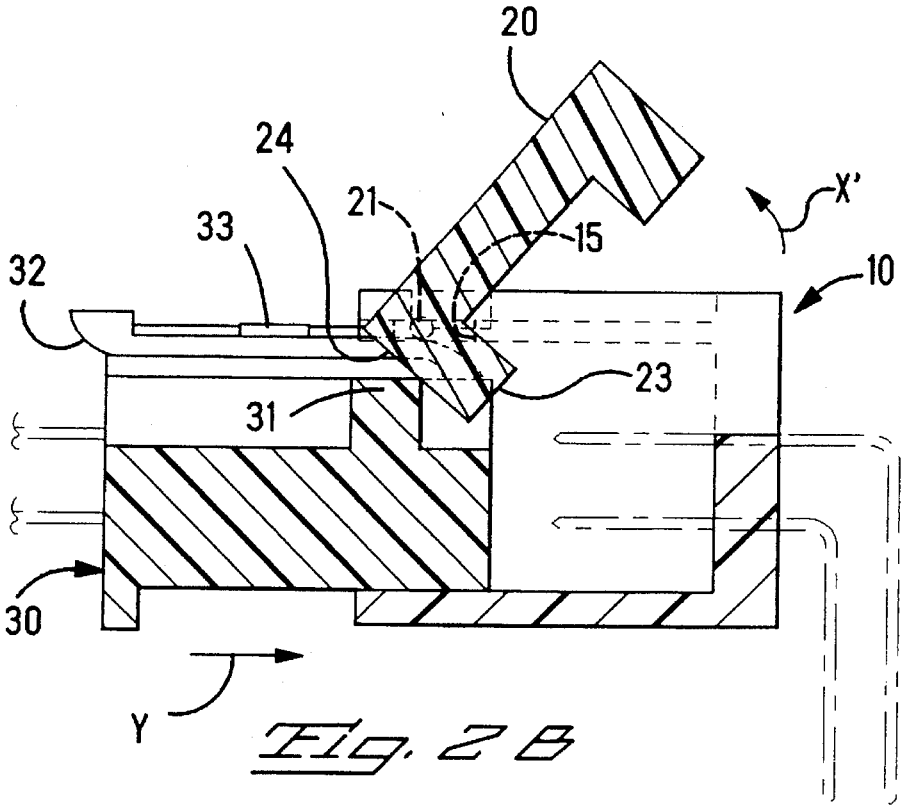
Figure 2C:
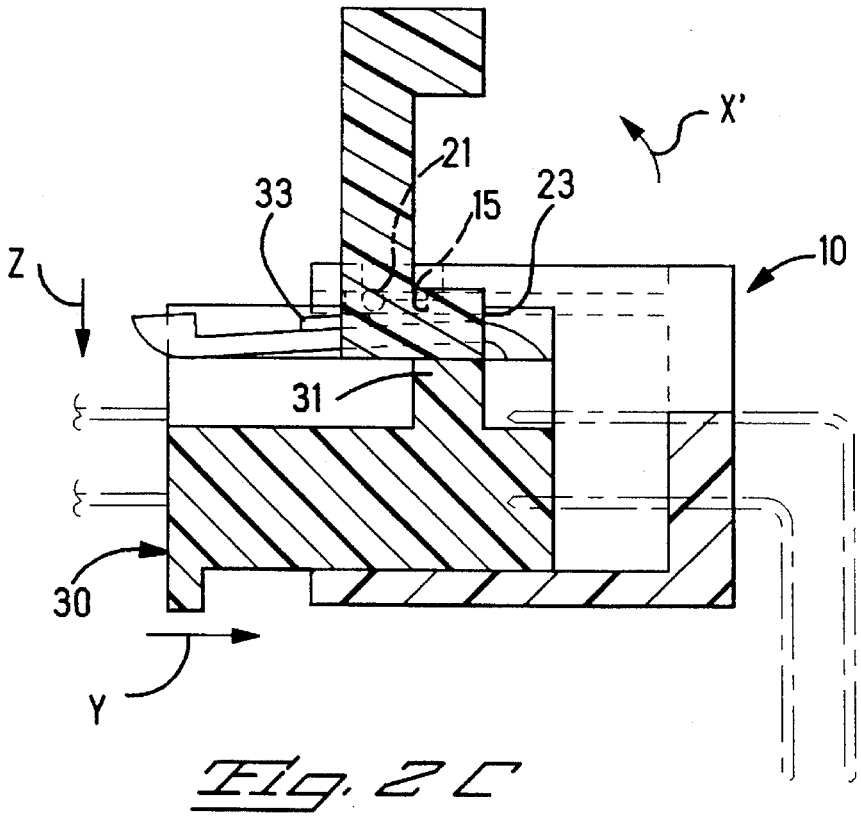

On the other hand, the latching element 32 of the male housing 30 enters the groove 14 of the female housing 10, and is deflected down in the direction shown by the arrow Z due to the pressure of the upper surface of the groove 14 on the lug 33 (see FIG. 2(C)).

Figure 2D:
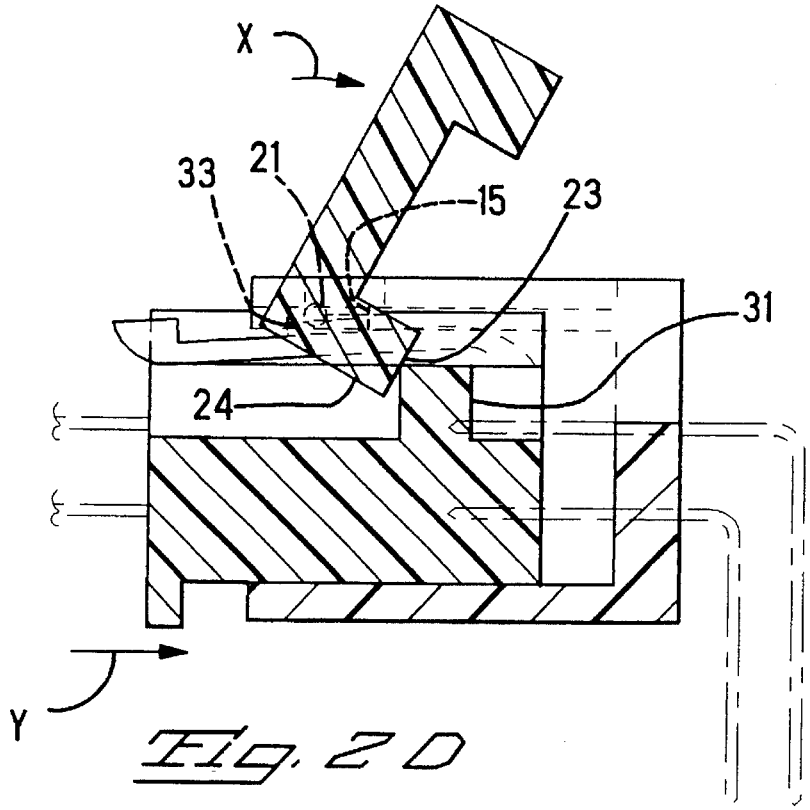
Figure 2E:
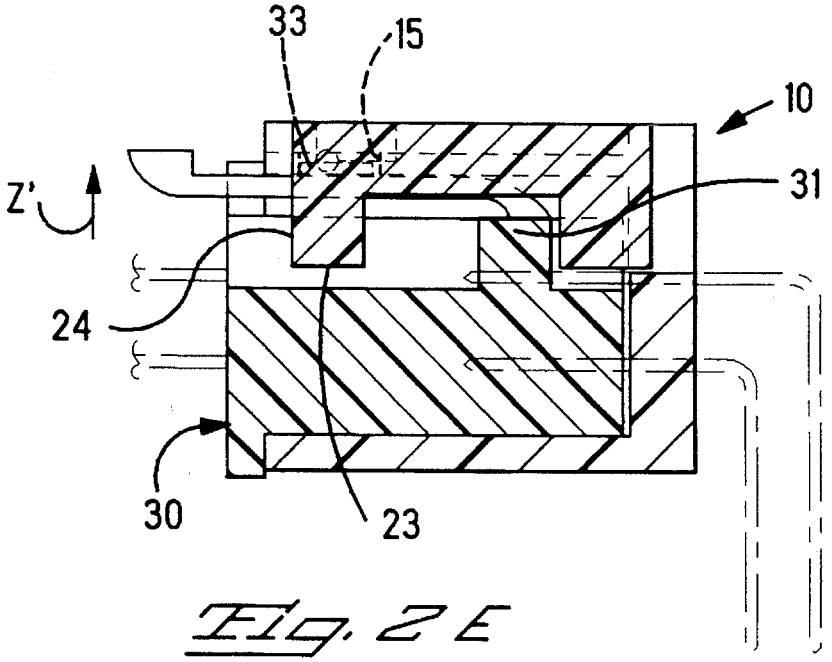

When the male housing 30 is moved further, the protrusion 31 of the male housing 30 comes against the side surface 23 of the rotating arm 20 (see FIG. 2(D)). After that, when both connectors become completely joined (see FIG. 2(E)), the lug 33 of the latching element 32 slips into the slot 15 of the groove 14 of the female housing 10. At this time, the latching element 32 restores its original position by snapping back in the direction shown by the arrow Z' and simultaneously with this, the protrusion 31 of the male housing disengages from the side surface 23 of the rotating arm 20 which by the action of the spring returns to its original position.

The rotating arm 20 is in a vertical position (shown in the FIG. 2(C)) up to the moment when the lug 33 snaps into the slot 15. The connector can be designed in such a way that the rotating arm 20 turns into its original position (as shown in the FIG. 2(E)) simultaneously with or after the engagement of the lug 33 and the slot 15. In this case, in order to provide for a smooth return of the rotating arm 20 into its original position, side surface 23 may be made inclined relative to the bottom surface 24, or it may have a curvature.

Therefore, the rotating arm 20 of this embodiment of the connector according to this invention indicated incomplete joining of the connectors, when it is raised, or the complete joining, when it is down.

Connectors according to this invention provide an easy means of detection of the condition of joining the connectors which detection can be made visually or by touch. Based on the variation in the position of the rotating arm (especially between not completely joined state and completely joined state), one can easily identify the mutual position of the connectors and to detect a miss in connection.

The detection can be made even easier if the rotating arm and housing of the connector according to this invention are made of different or contrasting colors.

This design can be used as a warning for assembly workers that a mistake was made in the process of connection, and it can be designed to serve as double protection against mistakes in the assembly work.

I claim:

1. An electrical connector having housings and an indicator to show if the housings are completely connected, comprising:

a female housing having latching means, a rotating arm attached to said female housing and pivotable around an axis; and a male housing having complementary latching means for latching with said female housing and a protrusion for engaging said rotating arm;

whereby when said male and female connectors are apart, the rotating arm is in a first position, the first position being substantially flush with said female housing, and as said male housing is inserted, said protrusion pushes said rotating arm into a second position, the second position being defined by said rotating arm being disposed substantially normal with respect to a longitudinal mating axis of said female housing, and when the housings are completely connected and said latching means have secured said housings together, said protrusion allows said arm to return to said first position thereby indicating complete connection of said housings.

2. The connector of claim 1, wherein said rotating arm is spring biased.

3. The connector of claim 1, wherein said rotating arm has axes on either side, said female housing having bearing surfaces, and said axes are disposed in said bearings.

4. The connector of claim 1, wherein said latching means on said male housing includes a cantilevered arm having a lug thereon.

5. The connector of claim 4, wherein said latching means on said female housing includes a latching slot for receiving said lug.

6. The connector of claim 1, wherein the rotating arm is pivotable about a pivot end having a surface, the protrusion cooperates with the surface of the pivot end for pivotal movement of the rotating arm when the housings are mated together.

7. The connector of claim 6, wherein the rotating arm is spring loaded such that said rotating arm returns to the first position, the first position being substantially parallel with the female housing on which the rotating arm is mounted.

8. The connector of claim 6, wherein the latch means on the male housing includes a latch arm and the latch means on the female housing includes a slot.

9. The connector of claim 1, wherein the first position has the rotating arm substantially flush with the female housing, the second position has the rotating arm extending beyond the female housing, and following complete mating, the rotating arm returns to the first position, substantially flush with the housing.

10. An electrical connector having a pair of matable housings integrally provided with a latch arm on one of the housings for latching with a complementary latching element on the other of the housings, further comprising:

a rotating arm pivotably mounted on one of said housings in the direction of mating of said matable housings and having a pivot end with a surface; and a protrusion formed on the other housing to cooperate with the surface of the rotating arm near the pivot end for pivotal movement of said rotating arm when said matable housings are mated with each other;

said rotating arm having a first position when said housing are apart, said first position being substantially flush with the one of said housings, and during mating of said housings, said protrusion pushes said rotating arm into a second position which is substantially normal to a mating axis of said housings, and when said housings are completely connected, said protrusion allows said rotating arm to return to said first position thereby indicating complete connection.

11. An electrical connector of claim 10, wherein said rotating arm is spring loaded so that said rotating arm is substantially parallel with said housing on which said rotating arm is mounted.

12. An electrical connector of claim 10, wherein said rotating arm and said latch arm are formed on different one of said matable housings.

* * * * *